US006019686A

United States Patent [19]

Gray

[11] Patent Number: 6,019,686

[45] Date of Patent: Feb. 1, 2000

[54] TOP WEIGHTED PUTTER

[76] Inventor: William R. Gray, 949 E. 36th St., Erie, Pa. 16504

[21] Appl. No.: 08/903,962

[22] Filed: Jul. 31, 1997

[51] Int. Cl.[7] ..... A63B 53/04

[52] U.S. Cl. ..... 473/313; 473/330; 473/334; 473/341

[58] Field of Search ..... 473/324, 325, 473/330, 331, 334, 335, 336, 337, 338, 339, 340, 341, 349, 350, 305–315, 288, 246, 245, 247, 248, 256, 251, 242, 219, 226

[56] References Cited

U.S. PATENT DOCUMENTS

| | | | |
|---|---|---|---|
| 1,139,738 | 5/1915 | Tyler . | |
| 2,932,515 | 4/1960 | May | 473/248 |
| 4,736,951 | 4/1988 | Grant | 473/246 |
| 5,253,869 | 10/1993 | Dingle et al. | 473/334 |
| 5,417,429 | 5/1995 | Strand | 473/251 |

FOREIGN PATENT DOCUMENTS

| | | | |
|---|---|---|---|
| 9006157 | 6/1990 | WIPO | 273/80.1 |

*Primary Examiner*—Sebastiano Passaniti

[57] ABSTRACT

A golf putter with a face of light weight construction, such as aluminum, and perimeter, heel-toe, weights, such as brass, attached above the striking area of the putter face on stilts that extend upward on the heel and toe of the putter face. The weights constitute the majority of the weight of the putter head. Slots in the stilts through which the weights are attached make the height of the center of gravity of the putter adjustable. When a ball is stroked with the putter with an ascending blow, to diminish the effect of the loft, the friction with the ball and the putter face allows the vertically high moment of inertia to impart overspin to the ball because the putter head rotates as such slightly at the moment of impact. When a ball is stroked with the putter with a descending blow, the putter head rotates slightly causing the friction of impact to break which allows the balls contact and friction with the putting green to have a greater effect on how the ball starts rolling.

9 Claims, 1 Drawing Sheet

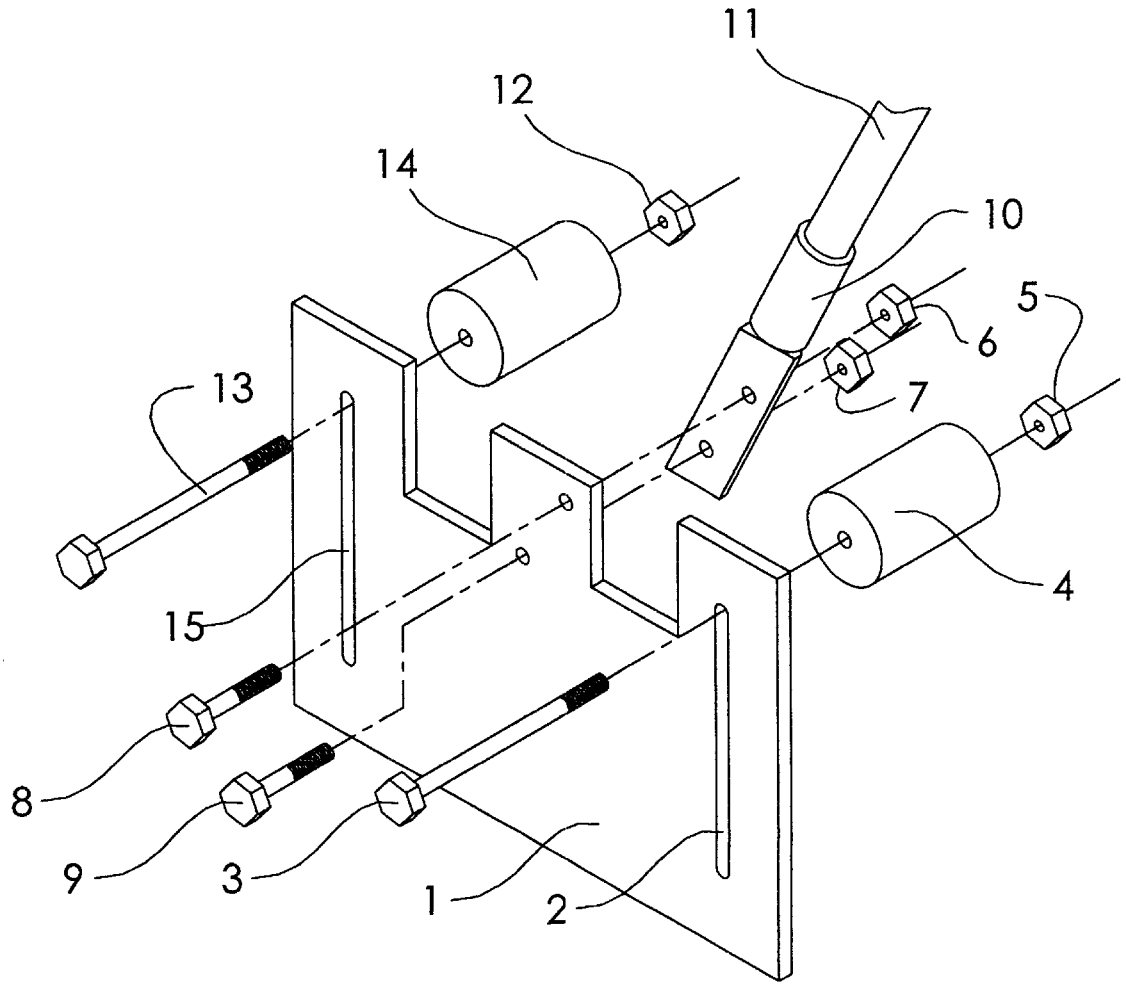
11
12
14
10
5
6
7
13
4
15
8
9
3
1
2

TOP WEIGHTED PUTTER

CROSS-REFERENCES TO RELATED APPLICATIONS

Not Applicable.

STATEMENT REGARDING FEDERALLY SPONSORED RESEARCH OR DEVELOPMENT

Not Applicable.

REFERENCE TO A "MICROFICHE APPENDIX"

Not Applicable

BACKGROUND OF THE INVENTION

1. FIELD OF THE INVENTION

The field of golf putters which are used to roll golf balls an the greens of golf courses in the game of golf.

BRIEF SUMMARY OF THE INVENTION

A golf putter with a center of gravity located above the intended contact spot with a golf ball. The purpose of which is to apply more force to the upper portion of the ball in contact with the putter at impact.

BRIEF DESCRIPTION OF THE SEVERAL VIEWS OF THE DRAWING(S)

The drawing is of the putter from the front with numbers pointing to the various parts of said putter. A corresponding list with descriptions of each number, which corresponds to a part of the putter is in the detailed description.

DETAILED DESCRIPTION OF THE PUTTER

The Following labels correspond to the drawing.

1. Putter Face or head.
2. Slot
3. Bolt
4. Weight.
5. Nut.
6. Nut
7. Nut
8. Bolt
9. Bolt
10. Hosel.
11. Golf shaft.
12. Nut.
13. Bolt.
14. Weight.
15. Slot.

The aluminum putter face is ⅛th inch thick 4 and ¾ inches long, and 1 and ½ inches high. The stilts, which are an integrated part of the putter face, are ⅛th inch thick, extend 1 and ½ inches guard at the heel and toe of the putter face and are 1 inch wide from the ends of the putter face. Slots in them 3/16ths of an inch wide extend from ¼ inch from the top of the stilts to ⅜ths of an inch of the bottom of the putter face. The brass weights are cylinders 1 inch long with a 1-inch diameter. Holes 3/16ths of an inch in diameter run through the cylinders. A flange is attached to the top and center of the putter face 1 inch by 1 inch with two 3/16th-inch holes in it diagonally at about 10 degrees from vertical. The hosel is a cylinder 1 inch long and ½ inch in diameter and is mostly hollow. The hosel has a 1 and ½-inch flange a ½-inch wide with holes that correspond to the holes in the putter faces flange.

The prototype putter was assembled such that the bolts holding the weights to the stilts are 1 inch above the top of the putter. The hosel is bolted to the putter face to provide about 3 degrees of loft. A shaft with a grip is glued into the hosel and extends from the putter head at about 10 degrees from vertical.

Current design philosophy behind today's putters is the elimination of side or horizontal spin. This is accomplished with perimeter weighting, at the toe and heel of the putter, to prevent twisting at impact of the putter, and with underspin, or vertical spin, which diminishes side, or horizontal, spin because, as with a gyro, a sphere can only rotate in one plane. Underspin diminishes sidespin, but necessitates that friction between the ball and the turf after contact to impart roll spin or overspin. This narrows the margin of error because imperfections in the turf or any side spin, in the form of underspin at anything from 90 degrees vertical, is magnified by the friction between the ball and turf to start the ball rolling. Henceforth the industries concentration upon inertia in their putters with a big sweet spot that will not twist and consequently impart sidespin.

Overspin is also vertical spin which would diminish side spin, and decrease friction, between ball and turf, after impact to get the ball rolling. This would diminish the effect of sidespin and to a larger degree imperfections in the turf. Many people have patented designs for putters claiming to produce overspin with certain techniques, but none that the professionals use claim as such.

The invention relates to a new and useful design utilizing laws of science that have not been obvious nor capitalized upon by anything but this invention at this time. The invention is called it the top weighted putter. The utilization of the putter described below with an ascending blow to a golf ball imparts specific amounts of overspin depending upon the setup of variables in the putter's design and just what type of stroke is executed with the putter. A means of capitalizing upon friction between the ball and turf with a descending stroke is also explained. In actual use I can say the prototype putted the ball straight and true by utilizing overspin rather than underspin. It was more accurate than any other putter I have used, especially on short putts, and the worse the turf conditions, as on public courses, the greater the disparity.

Specifications and descriptions of how the putter is used follows below. Claims 2 through 10 are made for this design and ramifications to it for the resulting utility that this putter performs, which result from the inventions superior insight into the laws of physics and golf dynamics as defined in the claims and ramifications.

A hosel is attached to the prototype above the center of the putter face between the stilts with bolts. Adding or removing washers between the hosel and the putter face can increase or decrease the loft of the face of the putter to the shaft which extends from the hosel. The putter was set with about 3 degrees of loft and the bolts, through the weights and slots in the stilts, one inch above the top of the putter face.

Scoring or milling the putter face helps to, increase and make more exact the friction between the putter face and ball at impact, enhance the feeling of the user, and making more abundant and consistent the amount of overspin applied to the ball. Raising the weights increases and lowering them decreases the overspin imparted such that, in combination with a specified ascent into the ball, the overspin could be made to match the velocity of the ball. This is preferred as testing indicates. Increasing the ascent of the putter to the ball increases overspin as well.

When a ball is stroked with the putter with a descending blow, the putter head rotates slightly causing the friction of impact to break which allows the balls contact and friction with the putting green to have a greater effect on how the ball starts rolling. Applying a friction reducing coating such as Teflon to the putter face allows the putting green to have almost total affect upon the ball as the putter slides down the back of the ball at impact.

Impartiality, or levelness, with the stroke of this putter causes it to function with about as much accuracy as ordinary putters do.

The utility of this design not only functions superiorly, It capitalizes, as other designs have tried to do on the concept of overspin, which make it very marketable. In fact, the marketability of this design is what makes it surprising that such a design has not been utilized before.

1. The hosel may be attached anywhere, as to the center on the prototype.

2. The weights could be 1 or more units attached to 1 or more extensions above the putter face. They may be adjustable as on the prototype.

3. The putter face may extend as high as or be an integral part of the extensions which raise the vertical height of attached weights above the impact area on the putter face.

4. The face of the putter may be processed and or coated, such as with interchangeable inserts, to increase or decrease, friction and feel, with the ball.

5. The putter face may extend up at any degree of vertical to the ground.

6. The shaft attached to the putter may extend up at any degree of vertical to the ground.

7. The head of the putter need not be flat. In fact it should probably have at least a half-inch sole extending back from the face, which the prototype does not have. Or any other ornamentation that might confuse the utility of the putter designs as I have defined them.

I claim:

1. A golf putter club head comprising: a front face including a ball striking surface and having a heel end having an integral heel extension adjacent thereto and a toe end having an integral toe extension adjacent thereto, a top surface, a back surface and a sole; said ball striking surface being bounded by the top surface, the sole, the heel extension and the toe extension; each of said toe extension and said heel extension extending substantially vertically from said sole and protruding upwardly beyond the plane of the top surface and having an uppermost surface; said club head including a center of gravity located between said heel end and said toe end; a flange connected to said top surface intermediate said heel extension and said toe extension; said flange including a hosel adjustably attached thereto;

said hosel including an upper end and a lower end; said upper end configured for receiving a golf club shaft;

said lower end being adjustably attached to said flange;

each of said toe extension and said heel extension including a substantially vertical slot extending generally from the sole toward said respective uppermost surface; said slot extending through each of said toe extension and said heel extension in a front-to-rear club head direction and dimensioned to receive a bolt passing therethrough;

a heel weight adjustably positioned on said heel extension;

a toe weight adjustably positioned on said toe extension;

each of said heel weight and said toe weight being adjustably connected to said heel extension and said toe extension, respectively, with said bolts; said heel weight and said toe weight being made of a material that is more dense than the material from which the club head is fabricated, whereby the heel weight and the toe weight may be selectively positioned along the slots and held stationary with said bolts in order to raise or lower the location of the center of gravity of the club head.

2. The golf putter club head of claim 1 wherein said flange further comprises a pair of bolts passing through said flange and engaging said lower end of said hosel.

3. The golf putter club head of claim 2 wherein said pair of bolts passing through said flange are offset relative to one another.

4. The golf putter club head of claim 4 wherein the offset defines an axis that is offset about 10 degrees from a vertical plane passing through the club head in a front-to-rear direction.

5. The golf putter club head of claim 1 wherein the toe weight and the heel weight further each include a plurality of weights.

6. The golf putter club head of claim 1 wherein the front face is provided with a loft with respect to a vertical plane passing through said club head in a heel-to-toe direction.

7. The golf putter club head of claim 6 wherein the loft is about 3 degrees.

8. The golf putter club head of claim 1 wherein the ball-striking surface is coated with a friction reducing coating.

9. The golf putter club head according to claim 6 wherein said loft is provided through the addition of one or more washers positioned between said flange and said hosel.

* * * * *